United States Patent [19]

Hardin et al.

[11] Patent Number: 4,945,986

[45] Date of Patent: Aug. 7, 1990

[54] CONSTANT HEAD PUMP FOR SONIC WAVE GENERATOR USED IN TREATING SUBSURFACE FORMATIONS

[75] Inventors: Nathaniel A. Hardin, Forsyth, Ga.; George C. Morgan, Birmingham, Ala.

[73] Assignee: N.A. Hardin 1977 Trust, N.A. Hardin, Trustee, D/B/A Sonofrac Associates, Forsyth, Ga.

[21] Appl. No.: 370,050

[22] Filed: Jun. 21, 1989

[51] Int. Cl.[5] ..... B06B 1/20; B06B 3/02; E21B 43/25

[52] U.S. Cl. ..... 166/249; 166/177; 417/53

[58] Field of Search ..... 166/249, 177, 113, 250, 166/248, 312; 417/53, 240, 437; 134/1; 175/56, 55

[56] References Cited

U.S. PATENT DOCUMENTS

| | | | |
|---|---|---|---|
| Re. 23,381 | 6/1951 | Bodine | 166/249 |
| 2,355,618 | 8/1944 | Bodine | 417/240 X |
| 2,667,932 | 2/1954 | Bodine | 166/72 |
| 2,670,801 | 3/1954 | Sherborne | 166/249 |
| 2,866,509 | 12/1958 | Brandon | 166/177 |
| 2,871,943 | 2/1959 | Bodine | 166/249 |
| 3,016,093 | 1/1962 | Bodine | 166/249 |
| 3,016,095 | 1/1962 | Bodine | 166/177 |
| 3,045,749 | 7/1962 | Brandon | 166/249 |
| 3,302,720 | 2/1967 | Brandon | 166/249 |
| 3,323,592 | 6/1967 | Brandon | 166/249 |
| 3,422,894 | 1/1969 | Brandon | 166/177 X |
| 3,520,362 | 7/1970 | Galle | 166/249 |
| 3,640,344 | 2/1972 | Brandon | 166/307 |
| 3,743,017 | 7/1973 | Fast et al. | 166/249 |
| 3,765,804 | 10/1973 | Brandon | 417/540 |
| 3,850,135 | 11/1974 | Galle | 166/249 X |
| 3,981,624 | 9/1976 | Brandon | 166/177 X |
| 4,022,275 | 10/1977 | Brandon | 166/249 |

*Primary Examiner*—Stephen J. Novosad
*Attorney, Agent, or Firm*—Head & Johnson

[57] ABSTRACT

A sonic wave generating device transmits variable wave energy to a fluid medium that is transmitted to objects such as subsurface petroliforous formations to be treated. A feed pump which pumps the medium to the devices includes means to maintain an increased hydrostatic or positive head to the suction inlet to the feed pump which prevents or neutralizes feed back energy waves from the wave generating device to the feed pump.

11 Claims, 3 Drawing Sheets

CONSTANT HEAD PUMP FOR SONIC WAVE GENERATOR USED IN TREATING SUBSURFACE FORMATIONS

BACKGROUND OF THE INVENTION

Broadly, this invention is directed to the treatment of objects, particularly fluid containing subsurface strata or formations for the purpose of increasing the production of the fluids therefrom.

The concept of utilizing sonic waves and/or variable high frequency vibrations in the treatment of subsurface strata or formation is found in the prior art including but not limited to the early patents of Sherborne U.S. Pat. No. 2,670,801 and Bodine U.S. Pat. Nos. 2,355,618; 2,667,932; 2,871,943; 3,016,093; 3,016,095; and Re. 23,381. These references have as a common denominator the creation and utilization of sonic standing waves, whether symmetrical or not which are repetitive or reoccurring without charge, as a means of increasing oil recovery.

The concept of methods and apparatus for creating sonic waves wherein the wave characteristics are variable or changeable at the will of the operator are found in many of the Clarence W. Brandon patents such as U.S. Pat. Nos. 3,981,624; 3,640,344; 3,045,749; 3,323,592; 2,866,509; 3,422,894; 3,302,720; 3,765,804; and 4,022,275.

For the purposes of this invention, Clarence W. Brandon, U.S. Pat. No. 3,981,624 issued Sept. 21, 1976 is incorporated herein by reference. In the aforesaid Brandon patent, the construction of the reciprocating pistons used in the sonic wave generator, i.e. the variable stroke pumping unit, sometimes referred to herein as "sonofrac machine" utilized a working plunger or piston which comprised a cylindrical member which was open at both ends yet divided by a partition. Reference is made to the description and specification relative to FIG. 33. Immediately adjacent the partition and extending towards the forward end of the piston was a longitudinally extending slot which constituted the inlet port opening into the hollow interior of the piston. At the outer end of the piston was a valve chamber terminating in a conical valve seat with a spring loaded mushroom type valve normally closing the end of the piston. These pistons and their valves are internally operable to receive fluid under pressure capable of forcing fluid out against the spring loaded valve at a higher pressure and frequency. The variable stroke pump required that liquid medium, e.g. water and/or oil, be delivered from a separate pump under sufficient pressure to enter the variable speed main pump piston along with and in conjunction with the movement of the piston. A triplex type feed pump, i.e., a low speed/high pressure pump, was provided as a means for delivering the liquid under pressure to the variable stroke sonofrac machine. It has been found to be important in treating subsurface formations that the energy generated by a sonofrac machine, such as found in the aforesaid Brandon patents, be directed away from the variable stroke pump generator into the formation with no part of that energy being lost or wasted, that is, that the energy not be allowed to reverberate back into the generating machine, or back to the feed pump.

The triplex feed pump was connected to an adjoining water tank with a supply or suction line for the source of liquid. Delivery of water from that tank into the piston of the triplex pump depended upon the very slight pressure exerted by the head or weight of water in the supply tank. In many instances this pressure was inadequate to overcome friction and resistance from the supply tank and suction inlet piping. Consequently, the cylinders of the triplex pump were not filled, and in some instances cavitation of the triplex pump occurred during operation. In other instances reflective or refractive energy waves from the sonofrac machine would disrupt the operation of the feed pump. As a result, the triplex pump was known to become damaged during tests and in any event was incapable of delivering sufficient water either in quantity or pressure to the variable stroke pump described in the aforesaid Brandon patent which has been incorporated by reference herein.

SUMMARY OF THE INVENTION

A primary object of this invention is to provide an apparatus and a method for producing high frequency vibration in a liquid medium wherein control of the amplitude and the frequency of the vibrations produced within the liquid medium occurs with greater efficiency, accuracy and precision.

A further object of the invention is to provide an apparatus and a method for creating high frequency vibrations (sonic, ultrasonic or infra sonic waves) as an energy carrying wave in a medium, usually liquid, wherein all of the characteristics of the wave can be controllably varied and applied to widely diversified uses such as tunneling, drilling, mining of various minerals, reduction of ores, pumping, oil well use, various pressing applications, extrusions of materials, recrystallizations of materials to increase strength, ice breaking, structure deforming, prestressing or compacting of materials, quarrying, drying of fibers, disintegration of coal, rock and limestone and many other uses.

More particularly, a very important object of the invention is to provide an apparatus and method specifically adapted for use in oil and gas subterranean formations and effectively treating the same by fracturing, acidizing, cementing, cleaning, water and gas floodings in secondary recovery techniques, drilling, and testing operations relative to any of the above.

A still further important object of the invention is to provide an apparatus and method whereby the high frequency vibrations, the character of the high frequency vibrations and the like are controllably varied without substantial reverberation or return energy being allowed to return back into the sonofrac machine and/or to the feed pump to the sonofrac machine.

Broadly speaking, the apparatus and methods of this invention comprise a basic sonofrac machine or energy generating means which will carry high frequency waves of variable characteristics, controlled by an operator as to amplitude, frequency and strength in a liquid medium. This medium is then transmitted from the sonofrac machine to an object, an area or subsurface formation to be treated. A feed pump means, typically a high-speed plunger pump such as a simplex, duplex, triplex, or quintuplex is operative to feed liquid medium under pressure to the sonofrac machine. A fluid reservoir for supplying the liquid medium is provided with an inlet conduit to the feed pump. A standpipe or centrifugal pump or other means to provide an inlet pressure head of fluid to the suction inlet of the feed pipe is provided as a means to absorb reverberating and/or reflected wave energy from the sonofrac machine to the feed pump.

DETAILED DESCRIPTION OF PREFERRED EMBODIMENT

Before explaining the present invention in detail, it is to be understood that the invention is not limited to its application to the details of construction and arrangement of parts illustrated in the accompanying drawings, since the invention is capable of other embodiments and of being practiced or carried out in various ways commensurate with the claims herein. Also it is to be understood that the phraseology or terminology employed herein is for the purpose of description and not of limitation.

Figure 1:
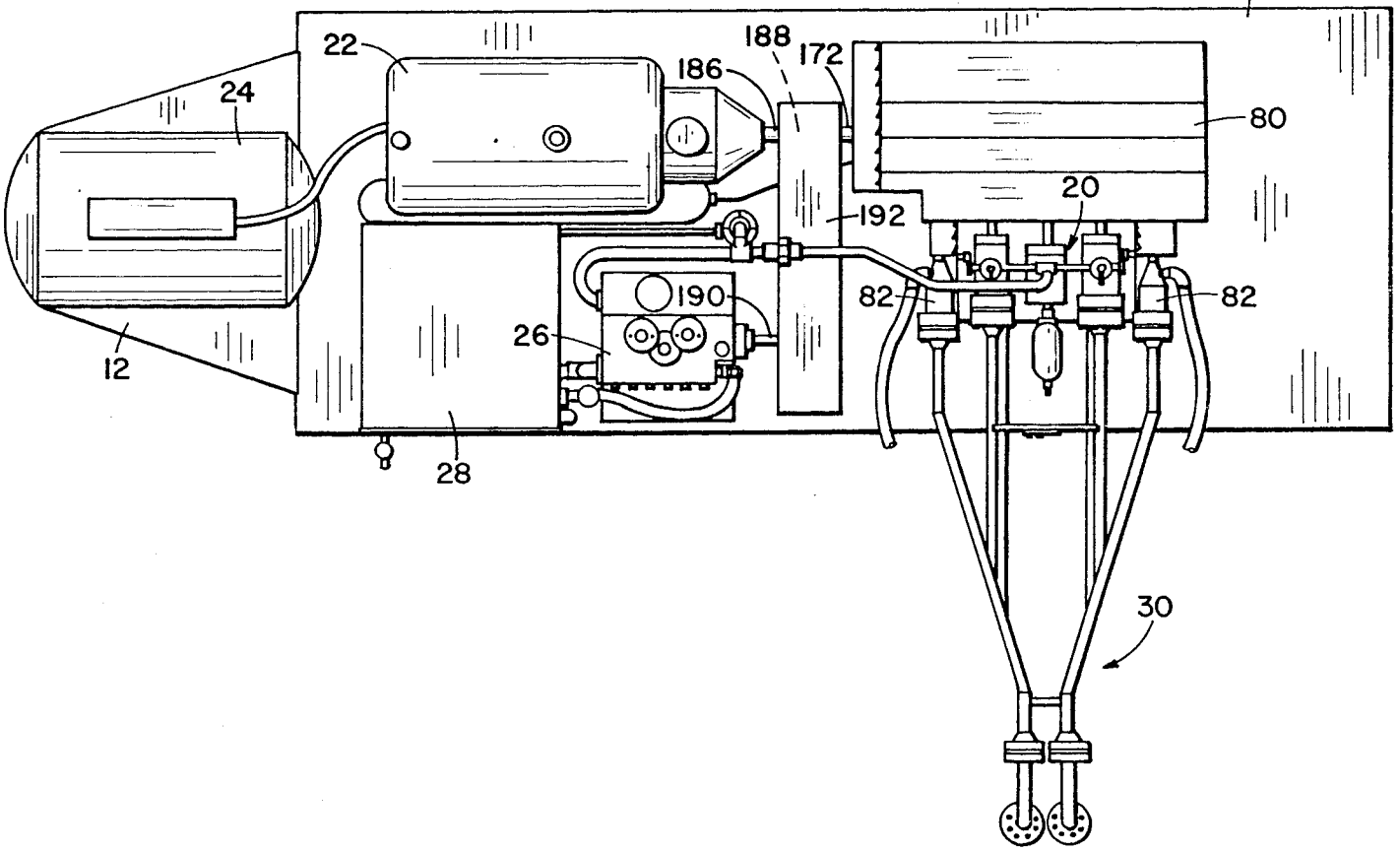
Fig. 1 (PRIOR ART)
FIG. 1 is a top elevational view of the prior art apparatus taken from U.S. Pat. No. 3,981,624 incorporating and showing the relative arrangement and the location of the various subassemblies of the apparatus to which this invention is adaptable upon a mobile base.

Referring now to FIG. 1, which is the apparatus of the prior art found in FIG. 1 of U.S. Pat. No. 3,981,624 dated Sept. 21, 1976 and incorporated herein by reference. The apparatus includes a mobile supporting frame which may comprise the bed of a truck or tailer, being illustrated in the drawings as consisting of a trailer bed 10 of any suitable design which has at its forward end a vertically offset or raised portion 12 which is adapted to be supported and secured as by a conventional fifth wheel assembly to the rear of a tractor type vehicle. It is upon the trailer bed 10 that all of the elements and subcombinations forming the preferred from of the apparatus in accordance with the invention are permanently mounted and secured in an operative relation for use or in a compact stored condition for ready transportation.

Placed upon the trailer bed is a sonofrace machine or energy wave generator consisting of a variable stroke pumping unit 20 and an internal combustion engine 22 which is the prime mover or power source for the apparatus, which then drives the sonofrac machine 80 and feed pump 26 using drive belts 188 via respective shafts 172 and 190. A storage tank 24 for fuel, typically LPG, such as butane, propane or the like, is provided for the internal combustion engine. Mounted upon the trailer bed is the feed pump unit 26 together with a tank 28 constituting a reservoir for fluid to be supplied to the feed pump. A Y-tube assembly 30 is operatively and detachably connected to the variable pump unit 20 for delivering the high frequency wave forms generated by the variable pump unit 20 to the surface or object to be treated and for receiving the fluid medium discharged from the variable pump unit. The overall purpose of the apparatus is to provide a variable stroke and variable capacity pumping unit 20 capable of imparting high frequency vibrations and energy carrying waves upon the fluid medium operatively contacting and/or discharged by the variable stroke pump whereby such vibrations and waves may be transmitted by the fluid medium to the surface, object or area that is to be treated by the same.

Figure 2:
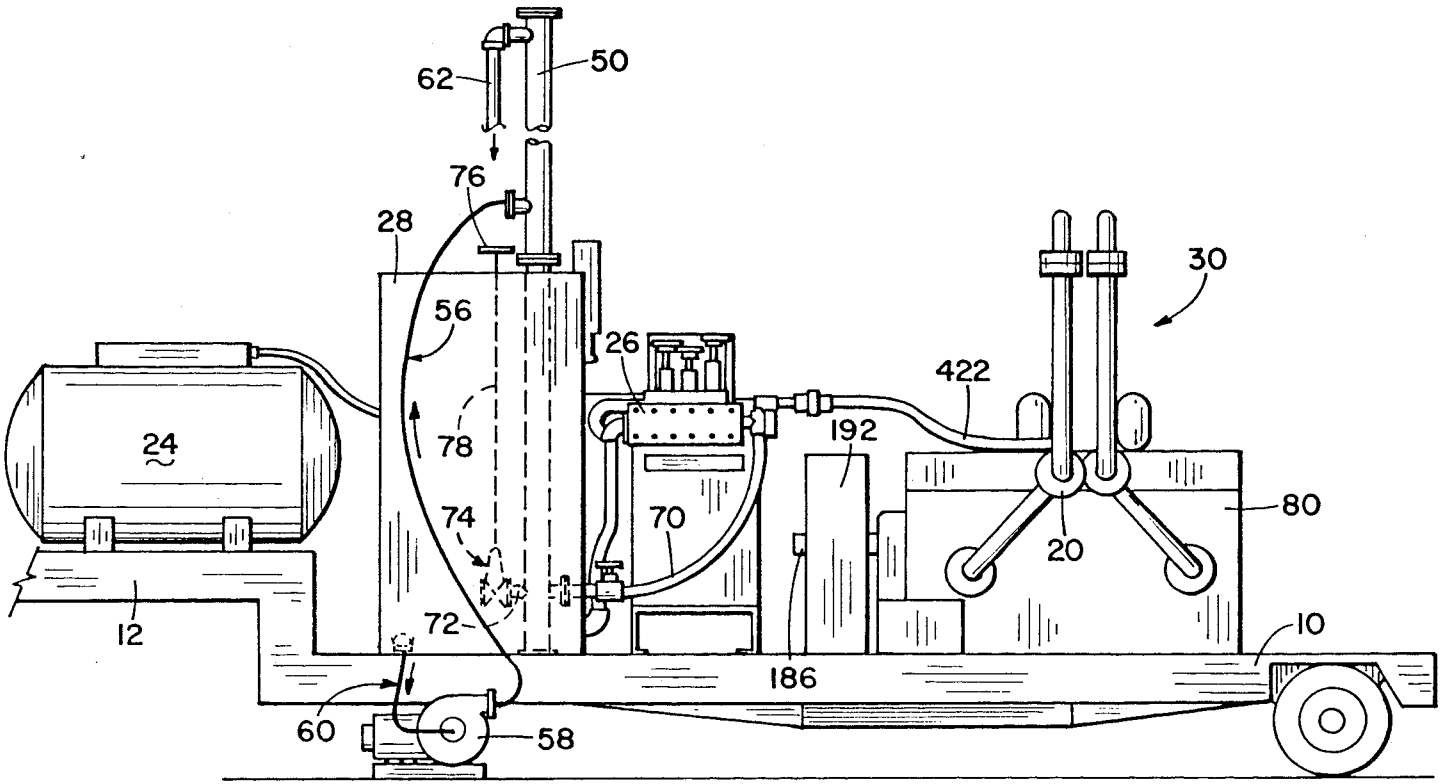
FIG. 2 is a side elevational view of the apparatus shown in FIG. 1 but including the improved concepts of this invention.
Figure 3:
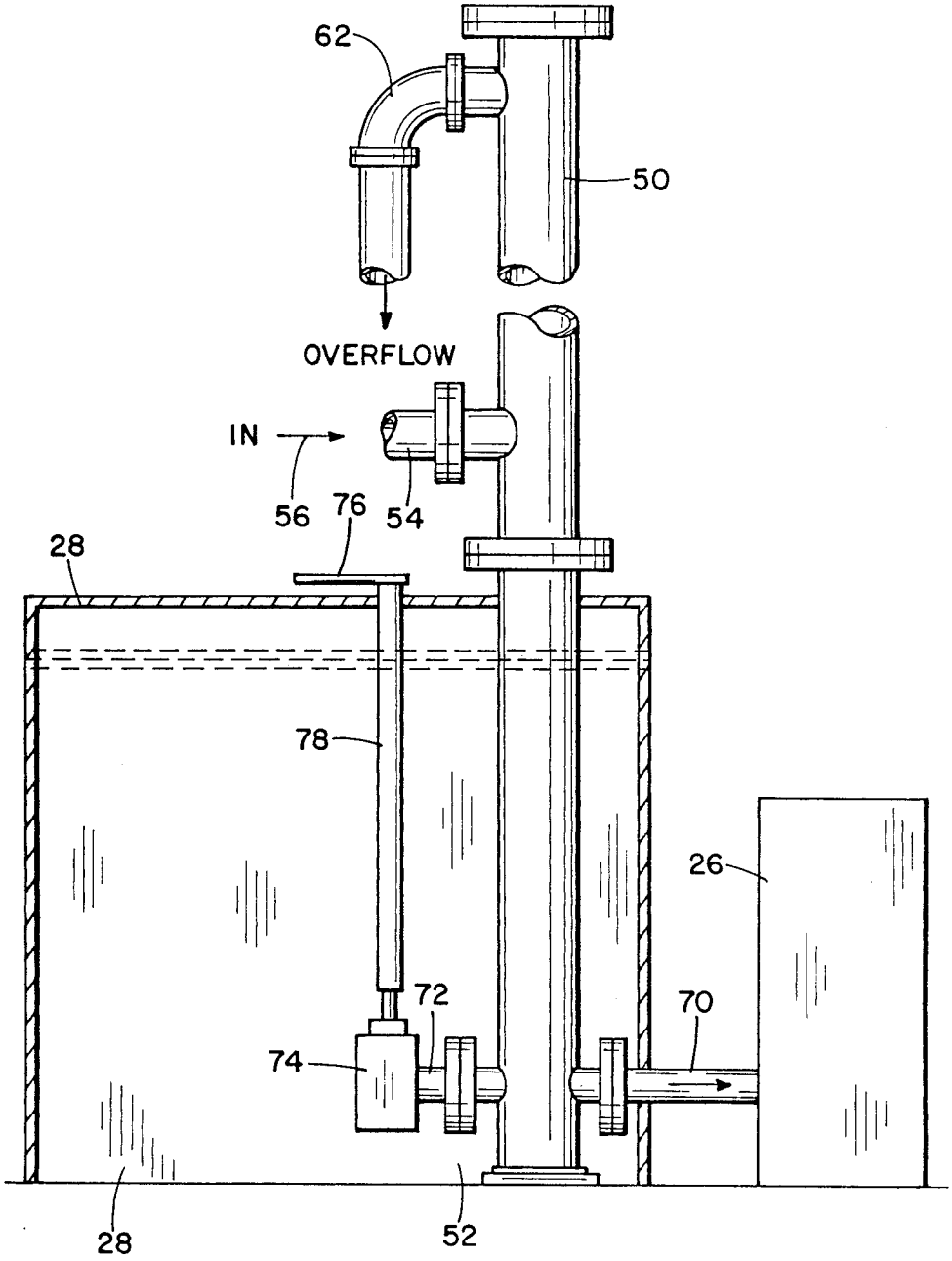
FIG. 3 is a partial side elevational view showing the portions of the invention enlarged.

Referring now to FIG. 2, the embodiment shown in FIG. 1 has been modified by the incorporation of a means to create a positive hydrostatic head comprising a standpipe 50 which is attached to and extends internally into the liquid reservoir 28 where the bottom end 52 thereof is rigidly attached to the bottom of the tank. It should be understood, however, that the standpipe 50 may be located exteriorly of the reservoir with proper modification of the piping, etc. An inlet 54 to the interior of the standpipe 50 is connected via conduit 56 to the outlet of centrifugal pump 58 with the inlet 60 being in communication with the interior of the liquid reservoir 28. Thus, in operation, the standpipe 50 is maintained with a constant hydrostatic head of liquid, with any overflow passing through conduit 62 from the upper end of the standpipe 50 back into the liquid reservoir 28. At the lower end of the reservoir the interior of the standpipe is in communication with the inlet line 70 to the feed pump 26, the pump 26 being preferably of the type known as a "triplex pump". An additional inlet to standpipe 50 and/or the inlet 70 is found at the lower end of the standpipe and identified by the numeral 72. A valve 74 operated by an exterior handle 76 by way of extension 78 is operative to permit passage of liquid medium from reservoir 28 directly into the standpipe and/or to the inlet 70 of pump 26 as need arises. The outlet of the pump 26 flows through conduit 422 to the sonofrac machine for use as described in the aforesaid Brandon U.S. Pat. No. 3,981,624.

As a typical example, the standpipe 50 of this invention comprises a 6 inch pipe about 20 feet in length made of schedule 40 steel. The valve 74 may be of ball or butterfly type, the outlet line 70 from the standpipe being 4 inch pipe. In normal operation, the liquid supply to the pump 26 comes entirely from the standpipe to supply continuous source of pressure obtained by the column of liquid medium, i.e. water, which is believed to insure against cavities or gaps in the suction to feed pump 26. Heretofore reciprocating pumps have traditionally used air chambers downstream from the pumps to smooth out pressure and flow. This invention provides a reversal of this concept by placing adequate volume and pressure ahead of the frequency generating system 20. It has been found that a constant column of water appears to provide a buffer or a block against reverse shocks attempting to travel back from the sonofrac machine 30 into the feed pump 26.

Although the apparatus herein has been described relative to the use of a standpipe 50, it is believed that similar continuous controllable supply of liquid could be provided by using a separate centrifugal pump providing flow of liquid to the inlet of the triplex pump 26, the purpose being to provide an over supply of liquid thereto and thus, the invention provides a substantially continuous and controllable volume and pressure of liquid via outlet line 422 to the sonofrac unit 30. In some instances a check valve may be placed in outlet line 422 to provide control over feed back waves to the feed pump 26.

Testing of the apparatus and method of this invention occurred on the L. D. Cook Lease, Section 28, Township 28 North, Range 13 East in Washington County, Okla., Well No. 12 on the Parker Tract which indicated that substantial fracturing occurred in the limestone formation. Throughout most of the tests, the differential pressure occurring in the well opposite the formation being treated stayed within the range of about 8–12 psi, with the pressure increasing till about ten minutes later when a substantial break in pressure occurred, creating differentials for several seconds from 78 to 129 psi, with the differential pressure then returning to the normal range until about one minute later when the pressure differential again increased from 57 to 142 psi with the pressure differential them maintaining a substantially constant differential within the 8–12 range for an additional 30 minutes. These peak differential pressures were indicative of the formation being fractured or otherwise treated.

What is claimed is:

1. Apparatus comprising:

energy generating means for carrying high frequency waves of variable characteristics as to amplitude, frequency and strength in a liquid medium which is transmitted to an object, area, or subsurface formation to be treated;

feed pump means having a suction inlet and an outlet for supplying said liquid medium under pressure to said energy generating means, a fluid reservoir for supplying said liquid medium to said suction inlet of said feed pump, and means to maintain a substantially positive and constant hydrostatic head to said suction inlet.

2. Apparatus of claim 1 wherein said means to maintain said hydrostatic head comprises a standpipe, means to maintain said standpipe filled with said liquid medium, an overflow conduit at the uppermost end of said standpipe, said overflow conduit in communication with said fluid reservoir.

3. Apparatus of claim 2 wherein said standpipe is schedule 40 pipe, six (6) inches in diameter and twenty (20) feet in height.

4. Apparatus of claim 2 wherein said means to maintain said standpipe filled comprises an auxiliary pump, the inlet of which is in communication with said fluid reservoir, and the outlet of which is in communication with the interior of said standpipe.

5. Apparatus of claim 4 wherein the outlet of said auxiliary pump connects at an upper part of said standpipe.

6. Apparatus of claim 1 including an exteriorly controlled valve for selective communication of the interior of said fluid reservoir with the interior of said standpipe.

7. Apparatus of claim 1 wherein said feed pump is a multiple plunger or piston type.

8. Apparatus of claim 7 wherein said pump is a triplex pump.

9. Apparatus of claim 1 wherein said outlet from said feed pump means includes a check valve.

10. A method of treating objects comprising the steps of:

generating, by a sonic or wave generator means, high frequency waves of variable characteristics as to amplitude, frequency, pressure, and volume into a liquid medium and transmitting said liquid medium to said object to be treated;

providing a feed pump having a suction inlet and an outlet means to supply liquid medium to said wave generator means, and providing a substantially constant hydrostatic pressure head of liquid to said suction inlet.

11. The method of claim 10 wherein said object to be treated is a subterranean oil producing formation.

* * * * *

UNITED STATES PATENT AND TRADEMARK OFFICE

CERTIFICATE OF CORRECTION

PATENT NO. : 4,945,986

DATED : August 7, 1990

INVENTOR(S) : Nathaniel A. Hardin et al

It is certified that error appears in the above—identified patent and that said Letters Patent is hereby corrected as shown below:

Column 2, line 35, change "drying" to --dying--

Column 3, line 30, change "tailer" to --trailer--

Column 3, line 37, change "from" to --form--

Column 5, line 4, change "them" to --then--

Signed and Sealed this

Twenty-fifth Day of February, 1992

*Attest:*

HARRY F. MANBECK, JR.

*Attesting Officer*

*Commissioner of Patents and Trademarks*